United States Patent [19]

Lang

[11] Patent Number: 4,467,302

[45] Date of Patent: Aug. 21, 1984

[54] CRT COLOR PURITY ADJUSTMENT APPARATUS

[75] Inventor: Warren R. Lang, Glendale, Ariz.

[73] Assignee: Sperry Corporation, New York, N.Y.

[21] Appl. No.: 478,422

[22] Filed: Mar. 24, 1983

[51] Int. Cl.[3] ..... H01F 1/00

[52] U.S. Cl. ..... 335/212; 335/210; 313/431

[58] Field of Search ..... 335/210, 212; 313/426, 313/427, 431

[56] References Cited

U.S. PATENT DOCUMENTS

| | | | |
|---|---|---|---|
| 3,742,406 | 6/1973 | Erickson | 335/212 |
| 4,050,042 | 9/1977 | Anthony | 335/212 |
| 4,233,581 | 11/1980 | Beaucamp | 335/212 |

*Primary Examiner*—George Harris

*Attorney, Agent, or Firm*—Howard P. Terry

[57] ABSTRACT

A color purity adjustment assembly for color cathode ray tube indicators of the shadow mask type wherein the two ring magnets surrounding the tube neck for determining the magnitude and direction of the resultant magnetic field across the neck are manually angularly adjustable about the tube neck in the same or opposite directions by means of a differential gearing arrangement coupled therebetween.

7 Claims, 3 Drawing Figures

CRT COLOR PURITY ADJUSTMENT APPARATUS

BACKGROUND OF THE INVENTION

1. Field of the Invention

The present invention relates generally to color cathode ray tube (CRT) indicators, such as full color indicators for displaying flight information to the pilots of an aircraft. More particularly, the invention relates to apparatus for adjusting the color purity of CRT indicators of the three cathode, shadow mask type.

2. Description of the Prior Art

As is well known, the color purity of a three gun, shadow mask type of color CRT indicators depends upon the proper angle at which the red, green and blue electron beams, as a unit, penetrate the hole pattern of the shadow mask and strike the red, green and blue phosphor triads on the internal surface of the CRT face or screen. Practical manufacturing tolerances usually prevent such properly angled penetration of the shadow mask hole pattern and color purity adjustment assemblies are usually required to compensate for such manufacturing tolerances. Such apparatus effectively repositions the electron beams, as a unit, so as to pass through the shadow mask apertures at the proper angle to provide color purity by energizing their respective red, green and blue phosphor dots without any overlap. This adjustment is usually accomplished by providing an adjustment magnetic field which reacts with the electron beam unit to slightly deflect the same to their required angle. Thus, the magnetic field must be capable of having its magnitude and its direction readily adjustable. Furthermore, normal purity adjustments are accomplished manually by an operator with the CRT energized and displaying a suitable test pattern.

Prior art purity adjustment apparatus consisted of a pair of independently adjustable ring magnets surrounding the neck of the CRT and located just forward of the three gun cathode assembly such that the resultant magnetic field of the two magnets interact with the three electron beams to effectively adjust their angular positions relative to the shadow mask and its associaed phosphor screen. Each ring magnet provides a magnetic field generally diametrically across the CRT neck and each magnet is adjustably supported on a structure fixed to the tube neck with some frictional engagement therebetween so that they remain in the positions at which they are adjusted. Normally, each magnetic is initialeach pole in opposite directions while the direction of the field may be adjusted by rotating like poles together in one direction or the other. In prior art apparatus, each ring magnet was provided with projecting tabs which could be grasped with the fingers and rotated as required. Since, as stated, such adjustments are made with the CRT operating, the operator was exposed to the dangers of very high voltage shocks. Further, in trying to adjust one of the magnetic field functions, it was very difficult to adjust the other without inadvertently readjusting the first and vice versa.

In some CRT display instruments, particularly those especially designed for use in aircraft, the CRT may be subjected to stray or uncontrollable magnetic fields which could adversely affect the quality of the display, including its color purity. Therefore, in order to insulate the CRT from such extraneous magnetic fields, the entire CRT to the rear of its display screen is surrounded by a magnetic shield, such as a low field attenuation shield made of high permeability nickel/iron sheets. Such shielding structure makes it next to impossible to adjust the purity using the prior art tabbed ring magnets.

The purity adjustment assembly of the present invention overcomes the disadvantages of the prior art assemblies and permits fully independent adjustment of magnetic field magnitude and direction without exposing the operator to dangerous shocks and permits such adjustments to be made with the CRT enclosed within the magnetic shield or other protective covering.

SUMMARY OF THE INVENTION

The purity adjustment assembly of the present invention comprises a pair of ring magnets rotatably supported on a base structure and interconnected through a differential-like mechanism such that, through access holes in the magnetic shield, the two ring magnets may be rotated in opposite directions to adjust the magnitude of the magnetic field and then rotated together to adjust the direction of the field. The operation is accomplished using suitable insulated tools to eliminate the danger of shock.

BRIEF DESCRIPTION OF THE DRAWINGS

A preferred embodiment of the present invention is illustrated in the attached drawings wherein.

DESCRIPTION OF THE PREFERRED EMBODIMENTS

In the following description, like reference characteristics will be used to identify corresponding parts of the assembly illustrated in all of the figures.

The purity adjustment assembly is adapted to be fixedly secured to the neck portion N of a conventional shadow mask type color cathode ray tube indicator having red, green and blue cathodes (not shown) for producing correspondng electron beams which ultimately are converged on the shadow mask and then upon their respective red, green and blue phosphor dots on the CRT faceplate (also not shown). A shield S surrounds the CRT to protect it from any stray magnetic fields that may be present in its surrounding environment, such as the instrument panel of an aircraft cockpit. The assembly is located along the CRT neck at a suitable position where the magentic field of the adjustment magnets may interact with the electron beams of the cathodes to precisely position the angle at which the beams penetrate the shadow mask holes relative to the desired shadow mask positions and thereby compensate for ay mispositioning of the tube's cathode structure in the tube neck during manufacture.

Figure 1:
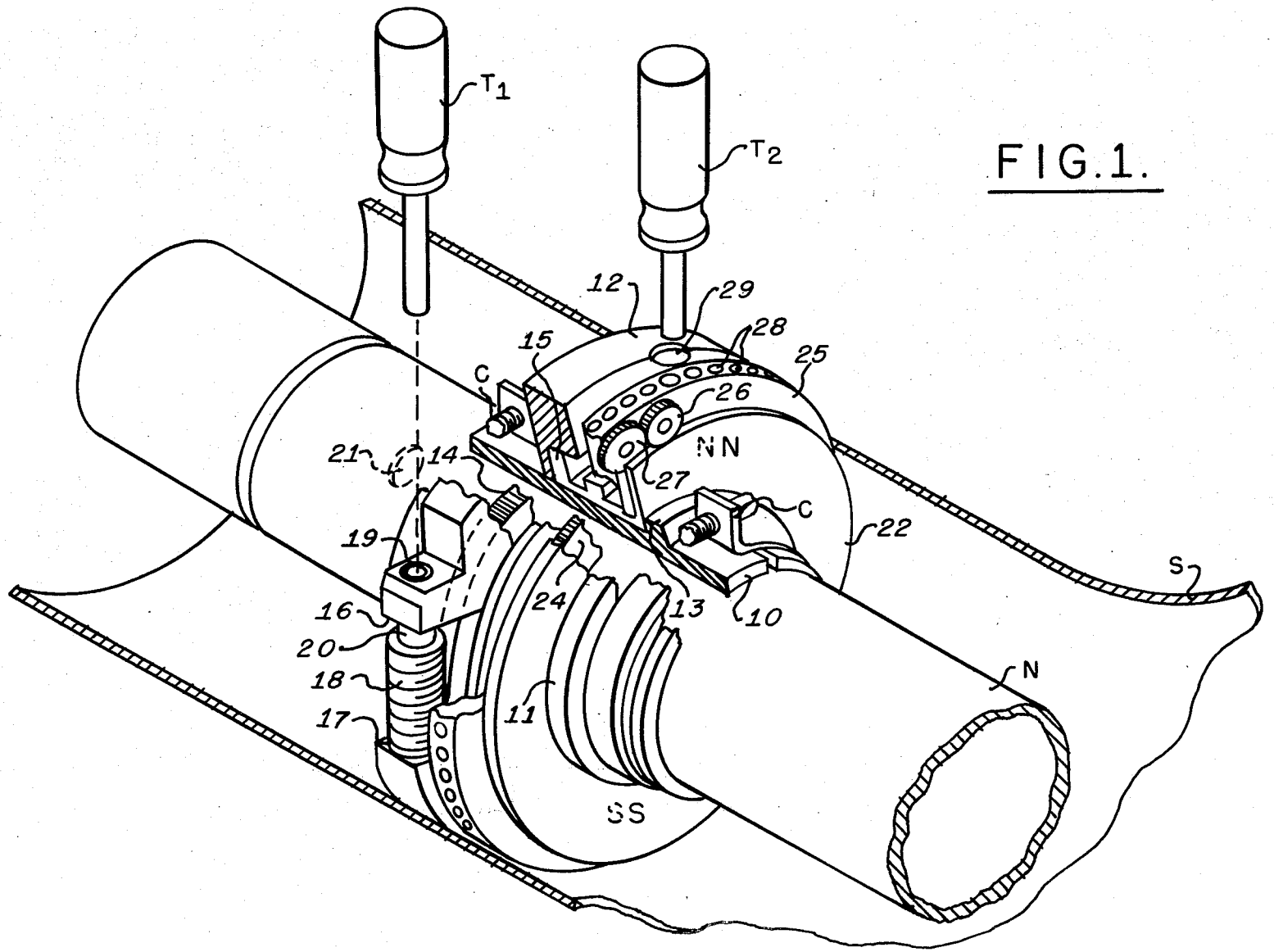
FIG. 1 is a perspective view of the purity adjustment assembly partially cut-away to show its component parts.

The adjustment assembly comprises a cylindrical base portion 10 adapted to slide onto the tube neck and when in the proper position to be clamped thereto by suitable clamps C shown in FIG. 1. Base 10 includes a forward shoulder 11 and a reaward, radially extending flanage 12 secured to base 10. The outer periphery of flange 12 may serve as a support for the rear portion of shield S.

Captured between shoulder 11 and flange 12 is a cylinderical sleeve 13 supported on and free to rotate about the base 10. At the rear end of sleeve 13 is fixedly secured a ring gear 14. The flange 12 is longitudinally cut out, as at 15, so that the ring gear is about centrally located in the flange's thickness. Flange 12 is also laterally cut out so as to provide a pair of tangentially spaced walls 16 and 17. Between these walls is journalled a worm gear 18 having a screw slot or Allen head slot 19 in one of its journal bearings 20. Access to the worm gear is provided through a suitable access hole 21 in the field S. A suitable insulated tool $T_1$, such a conventional Phillips head or Allen head screwdriver, is used by the operator to rotate worm gear 18. Worm gear 18 meshes with ring gear 14 so that when the worm gear is rotated, the sleeve 13 is likewise rotated relative to the base 10.

On the front end of sleeve 13 is fixedly secured one of the purity adjustment ring magnets 22. Magnet 22 is poled N-S as illustrated. Sleeve 13 also inludes a central shoulder 23 and between this shoulder and ring magnet 22 are captured the second purity adjustment ring magnet 24, poled as illustrated and a planetary gear support ring 25. Both of these elements 24 and 25 are free to rotate relative to the sleeve 13. Ring 25 provides a support for the journals of a pair of meshing planetary spur gears 26 and 27. The outer peripheries of each of the ring magnets 22 and 24 are provided with gear teeth and their relative diameters are such that ring magnet 22 meshes with spur gear 26 and ring magnet 24 meshes with spur gear 27 as illustrated. Also, the exterior surface of ring 28 is provided with a plurality of holes 28 so that it may be held fixed relative to flange 12 at any angular position it may be rotated to. A hole 29 in the shield S provides access to these holes for a suitable insulated tool $T_2$.

Figure 3:
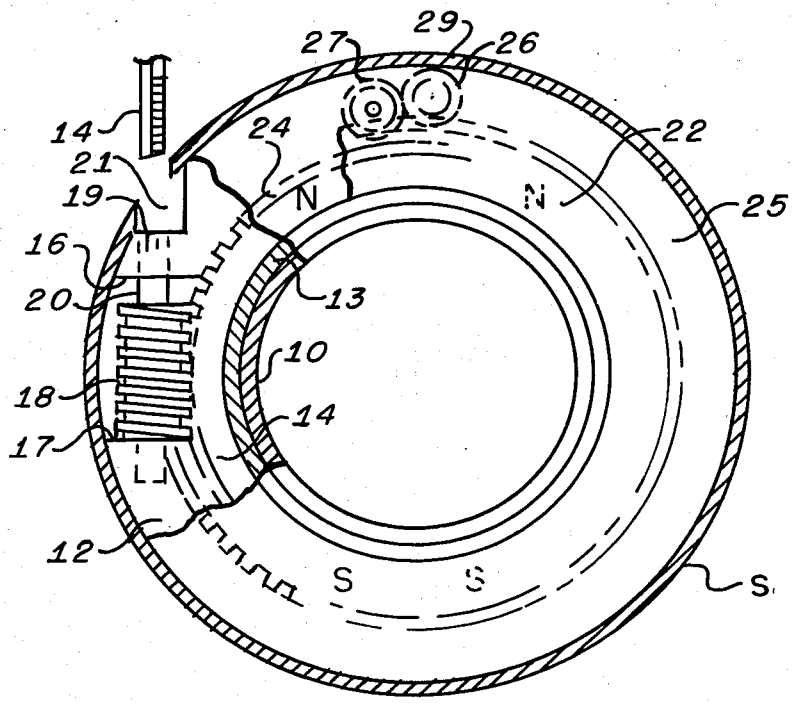
FIGS. 2 and 3 longitudinal and lateral cross-sectional view of the assembly, respectively.
Figure 2:
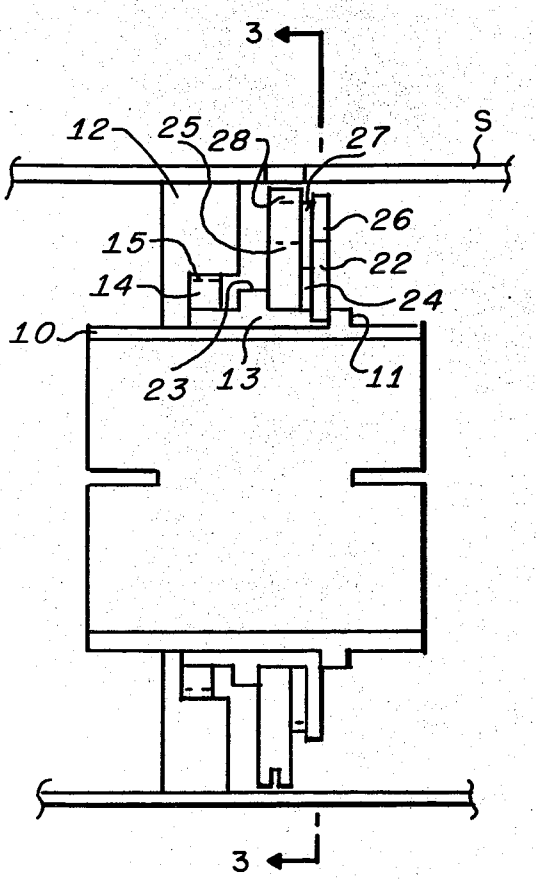

The operation of the purity adjustment assembly may now be described, it being understood that the adjustments are made with the CRT energized and providing a suitable test pattern. Normally, the desired magnitude of the magentic field across the tube neck is adjusted first. Assume that the two ring magnets are initially angularly positioned so that their respective North and South poles are aligned as shown in FIG. 1. In the position the resultant magnetic field is maximum. The operator inserts tool $T_2$ through hole 29 in shield S and into one of the holes 28 in the periphery of ring 25, thereby preventing any angular motion thereof. He now inserts tool $T_1$ through hole 21 in shield S and energized slot 19 in worm gear 18. Rotation of worm gear 18 in one direction or the other rotates sleeve 13 and ring magnet 22 through ring gear 14. In FIG. 3, ring gear 14 is rotated clockwise.

Since ring 25 is being held stationary, rotation of ring magnet 22 clockwise rotates spur gear 26 counter clockwise, spur gear 27 clockwise and ring magnet 24 counterclockwise. The diameters of ring magnet 22, gears 26 and 27 and ring magnet 24 are desirably selected to provide a one-to-one angular displacement between the ring magnets. Thus, ring magnet 24 is rotated counterclockwise through the same angle as ring magnet 22 is rotated clockwise producing an angular separation between their respective poles. This serves to reduce the resultant magnetic flux density or vector across the tube neck.

Now assume that it is necessary to vary the angular position of the magnetic flux vector across the tube neck. To accomplish this, the operator simply removes the tool $T_2$ disengaging ring 25 and then rotates tool $T_1$ in the desired direction. (FIG. 1 illustrates a slight rotation counterclockwise.) Since ring 25 is now free to rotate relative to the shield S and tube neck N, rotation of sleeve 13 by ring ger 14 not only rotates ring magnet 22 but also ring magnet 24, the spur gears 26 and 27 effectively locking the ring magnets together. It will be understood that the clearance tolerances between the ring magnets 22 and 24, spur gear support ring 25 relative to sleeve 13, together with the clearances between the sleeve 13, shoulder 11 and flange 12 are selected to provide some desirable frictional engagement between these elements so that the adjustments may be smoothly accomplished and their resultant positions maintained. This is important especially in airborne applications where the CRT may be subjected to some vibrations. It will be noted that the adjustment assembly effectively comprises a differential gear mechanism consisting of the ring magnets 22 and 24, spur gears 26 and 27 and spur gear ring 25.

From the foregoing, it will be appreciated that the present invention provides a simple, convenient and safe purity adjustment assembly for shadow mask color CRT's, especially those requiring shielding envelopes. The mechanism requires only simple, properly insulated tools and the adjustments may be made without exposure to high voltage shocks.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A color purity adjustment apparatus for a cathode ray tube comprising:

a base member fixedly secured to the neck of said tube, a sleeve member rotataby supported on said base member, a first ring magnet supported in and fixedly secured to said sleeve member for rotation relative to said base member, a second ring magnet rotatably supported on said sleeve member for rotation relative to said base member, and a differential gearing mechanism interconnecting said sleeve member and said first and second ring magnets for providing relative rotation of said ring magnets simultaneously in opposite directions in one mode of operation and simultaneously in like directions in another mode of operation.

2. A color purity adjustment apparatus as set forth in claim 1 wherein each of said ring magnets include gear means and said differential mechanism further comprises:

a ring member rotatably supported on said sleeve member, and further gearing means pivotally supported on said ring member and meshing with each of said ring magnet gear means.

3. A color purity adjustment apparatus as set forth in claim 2 further including:

a ring gear means fixed to said ring member, and adjustment means coupled with said ring gear means for rotating said further gear means.

4. A color purity adjustment apparatus as set forth in claim 3 wherein said adjustment means comprises:

worm gear means meshing with said ring gear means for rotating said ring gear means, flange means fixed to said base member for pivotally supporting said worm gear means, and tool means coupled to said worm gear means for permitting remote rotation thereof.

5. A color purity adjustment apparatus as set forth in claim 4 wherein said ring member includes locking means for preventing rotation thereof, relative to said base member upon rotation of said sleeve member by said adjustment means.

6. A color purity adjustment apparatus as set forth in claim 5 wherein said cathode ray tube is at least partially enclosed in a shield means for protection of said tube, said shield means having first and second access holes therethrough permitting insertion of said tool means.

7. A color purity adjustment apparatus as set forth in claim 6 wherein said flange means provides at least partial support of said shield means relative to said cathode ray tube.

* * * * *